US005837101A

United States Patent [19]

Ilvespääet al.

[11] Patent Number: 5,837,101

[45] Date of Patent: Nov. 17, 1998

[54] DEVICE FOR THREADING A PAPER WEB

[75] Inventors: Heikki Ilvespää; Antti Kuhasalo, both of Jyväskylä, Finland

[73] Assignee: Valmet Corp., Helsinki, Finland

[21] Appl. No.: 727,839

[22] Filed: Oct. 2, 1996

[30] Foreign Application Priority Data

Oct. 5, 1995 [FI] Finland ..... 954735

[51] Int. Cl.[6] ..... D21F 7/00; D21F 7/04

[52] U.S. Cl. ..... 162/255; 162/286; 34/117; 34/120; 34/122; 226/91

[58] Field of Search ..... 162/193, 255, 162/286; 226/91, 92, 97; 34/117, 118, 120, 122

[56] References Cited

U.S. PATENT DOCUMENTS

| | | | |
|---|---|---|---|
| 1,279,756 | 9/1918 | Pope | 162/193 |
| 1,338,094 | 4/1920 | Pope | 162/359.1 |
| 1,676,305 | 7/1928 | Weldon | 34/422 |
| 1,688,267 | 10/1928 | Cram | 162/193 |
| 1,734,879 | 11/1929 | Read | 162/193 |
| 1,789,515 | 1/1931 | Cram et al. | 162/193 |
| 4,543,160 | 9/1985 | Kerttula et al. | 162/193 |
| 5,232,554 | 8/1993 | Kotitschke | 162/193 |
| 5,375,753 | 12/1994 | Barthauer et al. | 226/92 |
| 5,377,892 | 1/1995 | Kimball | 226/92 |

FOREIGN PATENT DOCUMENTS

| | | |
|---|---|---|
| 50263 | 9/1975 | Finland . |
| 4037661 | 12/1991 | Germany . |

*Primary Examiner*—Stanley S. Silverman
*Assistant Examiner*—Jose A. Fortuna
*Attorney, Agent, or Firm*—Steinberg & Raskin, P.C.

[57] ABSTRACT

A device for threading a paper web from a dryer section to a finishing device situated after the dryer section in the running direction of the web including a rope threading arrangement. A leader strip is separated from the edge of the paper web in the dryer section and the leader strip is directed between a pair of ropes included in the rope threading arrangement. The leader strip is carried to the finishing device on support of the ropes. To effect the transfer of the leader strip from the drying wire to the rope, at the inlet side of the last drying cylinder in the dryer section, a rope gap is formed out of the ropes and the leader strip, which is supported by the drying wire thereat, is transferred by an air blowing into the rope gap. The leader strip is passed by the ropes over the last drying cylinder to the finishing device.

18 Claims, 3 Drawing Sheets

DEVICE FOR THREADING A PAPER WEB

FIELD OF THE INVENTION

The present invention relates to a method for threading a paper web from a dryer section of a paper machine to a finishing device following the dryer section in a running direction of the web by means of a rope threading arrangement. In the dryer section, a leader strip is separated from the edge of the paper web and is directed between a pair of ropes included in the rope threading arrangement. The leader strip is carried on support of the ropes and between the ropes to the finishing device.

Further, the present invention relates to a device for threading a paper web from the dryer section to a subsequently arrange finishing device which comprises a rope threading arrangement extending from the dryer section through the finishing device, in which arrangement the ropes run as a common loop.

BACKGROUND OF THE INVENTION

In the threading of a paper web, for example, from a forward dryer section through a film size press to an after-dryer section, in the existing constructions and concepts applied by the current assignee, a so-called Tail Shooter device is used by whose means the leader strip of the paper web shot into a rope gap. By means of such a device, the strip runs as accompanied and supported by ropes through the film size press into the after-dryer section. This construction is, however, not fully free from problems in all of its applications. In fact, the most essential problems are encountered mainly in passing the leader strip to the ropes. The threading by means of ropes is in itself quite free from problems and easy to carry out. Nonetheless, problems arise, for example, from the rather short gap between the drying cylinder and the rope gap, in which gap the leader strip runs unsupported and must be shifted to a relatively large extent in the lateral direction while unsupported. Moreover, the leader strip shifting technique applied in the Tail Shooter device is based on the air blow technique and does not shoot the leader strip in an invariable direction, but rather, the path of the strip is often varied quite substantially when the properties of the strip vary. These properties that affect the path of the strip include its weight, width, moisture, etc. Thus, the Tail Shooter device cannot be adjusted to operate optimally in all operating conditions, which vary from machine to machine. The leader strip also often remains a slack "strip bag" between the forward dryer section and the film size press, in which case, during the time of tightening of the strip, manual control from outside is needed.

OBJECTS AND SUMMARY OF THE INVENTION

Accordingly, it is an object of the present invention to provide a new and improved method and device for threading a paper web.

It is another object of the present invention to provide a new and improved method and device for threading a web by means of which the above drawbacks related to the prior art are substantially eliminated.

In view of achieving these objects of the invention, which will be described in more detail in the following, and others, in the method in accordance with the invention, a rope gap is formed out of a pair of ropes at an inlet side of a last drying cylinder in the dryer section and a leader strip, which is supported by a drying wire in the dryer section, is transferred by means of an air blowing or blowings into the rope gap. The leader strip is passed by means of these ropes over the last drying cylinder and thereafter to the finishing device following the dryer section in the running direction of the web.

The device in accordance with the invention comprises means for forming a rope gap from a pair of ropes at an inlet side of the last drying cylinder in the dryer section, a drying wire for supporting a leader strip cut from the web, and means for transferring or directing the leader strip after it is cut into the rope gap, e.g., an air blowing device, such that the leader strip passes on support of the ropes, i.e., between the ropes which reconverge after the rope gap, over the last drying cylinder and then to the finishing device situated after the dryer section in the running direction of the web.

In one embodiment of the method for threading a paper web from a dryer section to a finishing device situated after the dryer section in a running direction of the web wherein the web is supported on a drying wire in the dryer section, the method comprising the steps of forming a leader strip from the web before a last drying cylinder in the dryer section, directing a pair of ropes in respective loops over the last drying cylinder in the dryer section and into the finishing device at a side of the web, forming a gap between the ropes at a location before the last drying cylinder in the dryer section, directing the leader strip from a position in which it is supported on the drying wire into the gap between the ropes before the last drying cylinder in the dryer section, and pressing the leader strip between the ropes such that the leader strip is carried over the last drying cylinder and into the finishing device on support of the ropes. In certain constructions, the gap between the ropes is formed at an inlet side of the last drying cylinder and the leader strip is directed into the gap between the ropes by directing an air blowing at the leader strip, for example, from a location in opposed relationship to an interior region of the drying wire in a direction toward the rope gap and at an angle in relation to a direction transverse to the running direction of the web. In this manner, the air blowing grasps the leader strip substantially before the rope gap and transfers the leader strip under control in the direction transverse to the running direction of the web into the rope gap. The leader strip can be tightened by subjecting the leader strip to a speed differential between the last drying cylinder in the dryer section during which the leader strip is moved at the speed of the drying wire which supports it thereat and the finishing device during which the leader strip moves at the speed of the ropes. Most often, the speed of the leader strip carried between the ropes in the finishing device is greater than the sped of the leader strip as it is supported by the drying wire in the dryer section. The speed of the ropes can be set to a crawling speed after the web has been threaded.

In other embodiments, if the finishing device is a film size press, the ropes can be directed through the finishing section and into an after-dryer section after the size press such that the leader strip is carried between the ropes from the dryer section through the size press and then into the after-dryer section. If the finishing device is a calender, the ropes can be directed through the calender such that the leader strip is carried from the dryer section through the calender.

The device for threading a paper web from a dryer section to a finishing device situated after the dryer section in a running direction of the web, whereby the web is supported on a drying wire in the dryer section, basically comprises guide means for guiding a pair of ropes in a substantially common loop at least over a last drying cylinder in the dryer section and into the finishing device at a side of the web, forming means for forming a rope gap between the ropes at a location before the last drying cylinder in the dryer section, and transfer means for transferring the leader strip from a position in which it is supported on the drying wire into the rope gap between the ropes such that the leader strip is carried between the ropes over the last drying cylinder and into the finishing device. The rope gap forming means may be arranged to form the rope gap at an inlet side of the last drying cylinder in the dryer section while the transfer means may comprise a blow nozzle for directing an air blowing at the leader strip from a location in opposed relationship to an interior region of the drying wire in a direction toward the rope gap and at an angle in relation to a direction transverse to the running direction of the web such that the air blowing moves the leader strip in the direction transverse to the running direction of the web into the rope gap.

The device may include tightening means for tightening the leader strip and providing a speed differential for the leader strip between the last drying cylinder over which it is carried on the drying wire and the finishing device into which it is carried between the ropes. Such tightening means may comprise a rope-groove ring having a recess for receiving the ropes, and bearing means for mounting the rope-groove ring on the last drying cylinder such that the rope-groove ring is rotatable at a different speed than the last drying cylinder, or in the alternative, a rope pulley having a recess for receiving the ropes, and bearing means for mounting the rope pulley on a shaft of the last drying cylinder such that the rope pulley ring is rotatable at a different speed than the last drying cylinder and whereby the rope pulley extends from a mounting location proximate the shaft to a location adjacent an outer surface of the last drying cylinder.

By means of the present invention, a number of significant advantages are obtained over the prior art, and of these advantages, for example, the following should be mentioned. In the threading arrangement in accordance with the invention, a slack strip bag is not formed between the last drying cylinder in the forward dryer section and the film size press (the finishing device in this instance). The difference in draw between the forward dryer section and the after-dryer section can be regulated readily. In the threading arrangement in accordance with the invention, a fully supported draw of the leader strip is obtained between the forward dryer section and the after-dryer section. The operation of the transfer blowing is not sensitive to variations in the properties of the leader strip, nor is the run of the wide web placed at the side of the strip disturbed by the effect of the transfer blowing. Besides in a size press, the threading in accordance with the invention can also be applied in connection with other finishing devices situated after the dryer section or even more generally from a dryer cylinder to a finishing device. The invention is particularly usable in threading through a calender, in particular through a soft calender or an equivalent device, which is not followed by an after-dryer section. The result of all of these advantages is threading that operates considerably more reliably than in the prior art constructions.

Further advantages and characteristic features of the invention will come out in the following detailed description of the invention.

In the following, the invention will be described in more detail with reference to the figures in the accompanying drawings. However, the invention is not strictly confined to the details of the illustrations in these figures.

BRIEF DESCRIPTION OF THE DRAWINGS

The following drawings are illustrative of embodiments of the invention and are not meant to limit the scope of the invention as encompassed by the claims.

FIG. 2A is a more detailed illustration corresponding to FIG. 1 of the threading area itself, FIG. 2B shows the threading area viewed in the direction of the arrow B in FIG. 2A and FIG. 2C is a partial sectional view taken along the line 2C—2C in FIG. 2A.

DETAILED DESCRIPTION OF THE INVENTION

Figure 1:
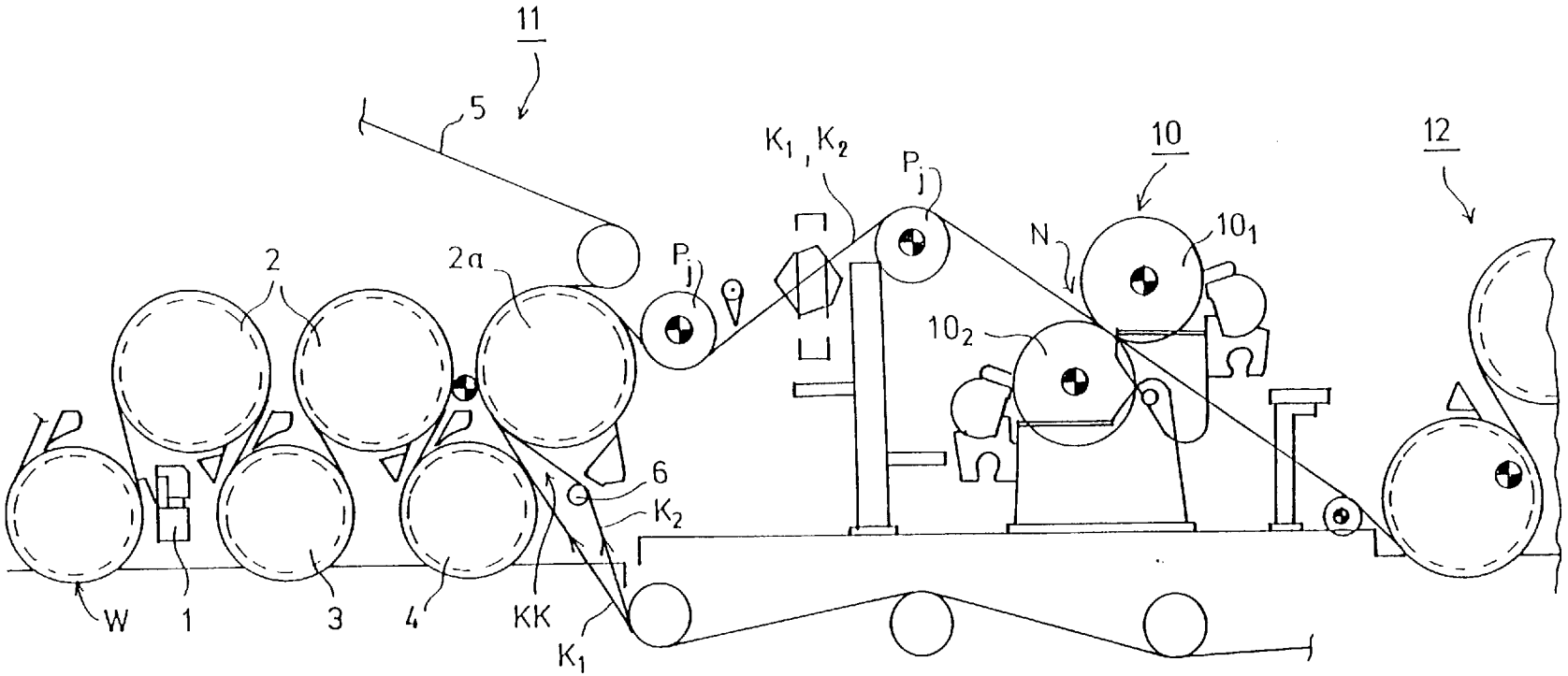
FIG. 1 is a schematic overall illustration of the threading arrangement in accordance with the present invention through a film size press from a forward dryer section to an after-dryer section.

Referring to the accompanying drawings wherein the same reference numerals refer to the same elements, in FIG. 1 the film size press is denoted generally by reference numeral 10 and is illustrated only schematically. In the typical construction, the film size press 10 comprises size press rolls $\mathbf{10}_1$ and $\mathbf{10}_2$ which form a size press nip N therebetween. In FIG. 1, a forward dryer section is denoted generally by reference numeral 11, and an after-dryer section is denoted generally by reference numeral 12, i.e., a dryer section situated after the finishing device. The dryer sections 11,12 comprise drying cylinders and suction rolls arranged alternatingly in accordance with a certain pattern, for example the arrangement shown in FIG. 1, and over which the paper web W runs in a meandering path. In the after-dryer section 12, the drying cylinders and suction rolls have not been illustrated in more detail, but in the forward dryer section 11 the drying cylinders are denoted by reference numeral 2 and the suction rolls are denoted by reference numerals 3 and 4. In FIG. 1, the forward dryer section is a dryer section provided with single-wire draw, wherein a drying wire for supporting the web is denoted by reference numeral 5. During operation of the machine, the paper web W runs in the forward dryer section 11 on support of the drying wire 5 between the drying cylinders 2 and the suction rolls 3,4, and from the forward dryer section 11, the web W is passed through the nip N of the film size press 10 and further into the after-dryer section 12.

During threading of the web, a cutter 1 placed in the forward dryer section 11 cuts an edge strip 7 from the web W, which strip runs over the drying cylinders 2 and the suction rolls 3,4 on support of the drying wire 5. The cutter 1 may be any known web or leader cutting device and the edge strip 7 shown in FIG. 2B (also commonly referred to as a leader or leader strip) may be cut from the web at other locations in the forward dryer section 11 not necessarily at the location shown. The transfer of the edge strip, i.e., of the leader strip, from the forward dryer section 11 into the nip N of the film size press 10 and from it further into the after-dryer section 12 is carried out by means of a rope threading in accordance with the invention. The rope threading arrangement consists of two ropes $K_1$ and $K_2$ which run as a common loop from a location in the forward dryer section 11 through the nip N in the film size press 10 into the after-dryer section 12.

Although not shown in detail in FIG. 1, the after-dryer section 12 can be provided with ropes of its own. In such a case, the transfer of the leader strip N from the ropes $K_1$,$K_2$ passing through the nip N in the film size press 10 to the ropes of the after-dryer section 12 might be carried out, for example, in FIG. 1, in the area of the first lower cylinder of the after-dryer section 12. The leader strip 7 (FIG. 2B) is already transferred to the ropes $K_1$,$K_2$by means of an air blowing or air blowings before the last drying cylinder in the forward dryer section 11, which cylinder is denoted by reference numeral 2*a* in FIG. 1. It should be understood by those skilled in the art that the leader strip 7 can be directed by other means to the ropes $K_1$,$K_2$.

Figure 2B:
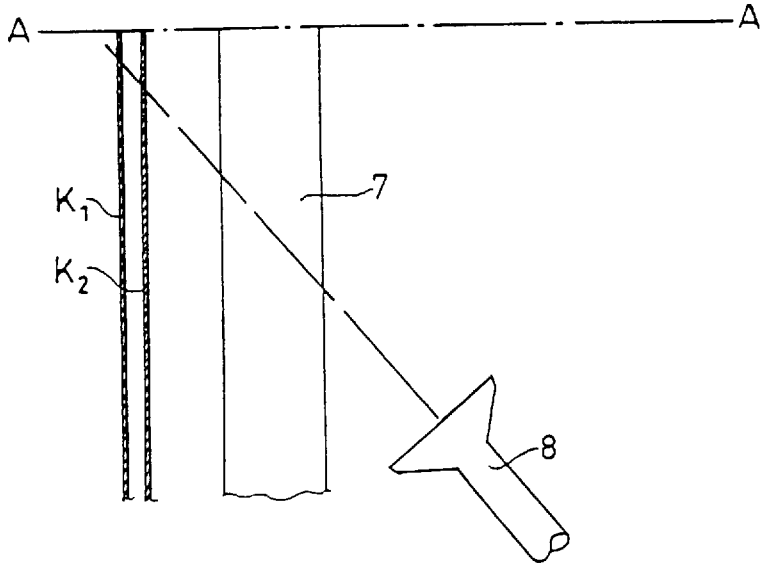
FIGS. 2A, 2B and 2C are more detailed illustrations of the threading arrangement whereby
Figure 2D:
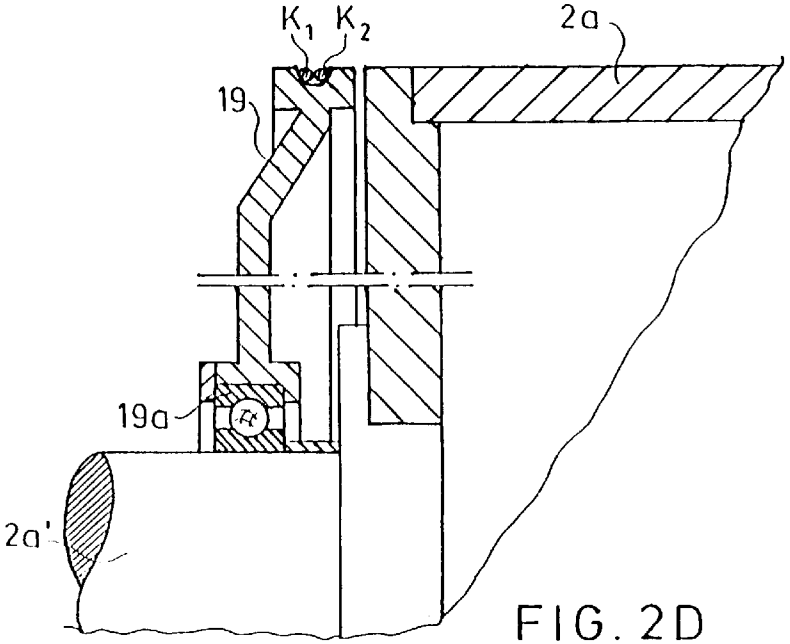
FIG. 2D shows an alternative construction of the partial sectional view taken along the line 2C—2C in FIG. 2A.
Figure 2A:
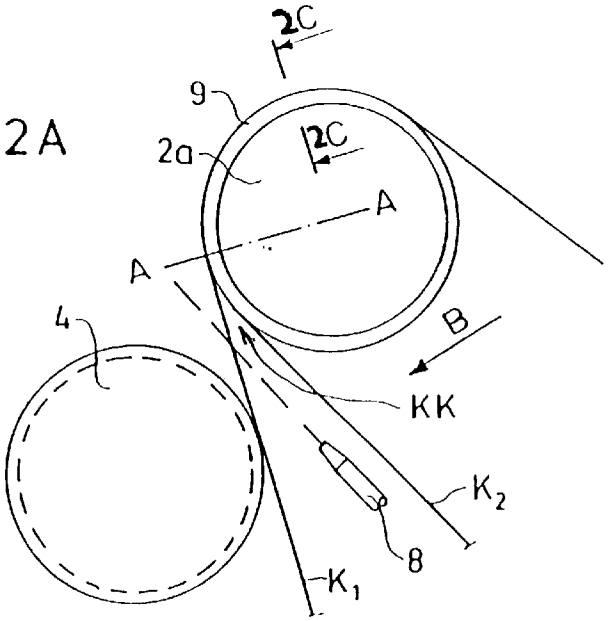

The transfer of the leader strip 7 to the ropes is arranged so that, as shown in FIGS. 1 and 2A, at the inlet side of the last drying cylinder 2*a* of the forward dryer section 11, a rope gap KK has been formed (i.e., a space between the ropes resulting from the distancing of one rope from the other), into which the leader strip 7 is transferred by means of air blowing. As described above, the ropes $K_1$,$K_2$ run from the forward dryer section 11 to the after-dryer section 12 as a common loop, in which case the rope gap KK is formed before the last dryer cylinder 2*a* by means of a rope pulley 6, which separates the ropes $K_1$,$K_2$ from one another. Other mechanisms for separating the ropes can also be used in the invention. Since the leader strip 7 is still supported by the drying wire 5 at that point, it can be transferred sideways into the rope gap KK easily and in a controlled manner by means of air blowing (i.e., in a direction toward the side of the web).

To effect the transfer of the leader strip 7, in the area of the rope gap KK, a blow nozzle 8 has been arranged, out of which an air blowing is directed at the rope gap KK and which is inclined outward from the web W in the manner shown in FIGS. 2A and 2B, so that the air blowing grasps the leader strip 7 before the rope gap and shifts the strip under control into the rope gap KK.

Figure 2C:
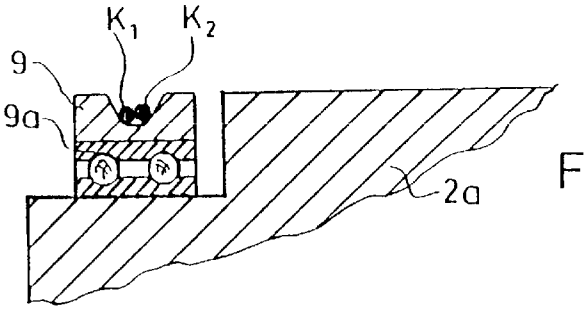

As shown in FIGS. 2A and 2C, the last drying cylinder 2*a* in the forward dryer section 11 is provided with a separately journalled rope-groove ring 9 or equivalent, over which the ropes $K_1$,$K_2$ pass. Such a rope-groove ring 9, which is journalled on the drying cylinder 2*a* separately by bearing means 9*a*, is necessary because it is possible to produce a difference in speed between the forward dryer section 11 and the film size press 10 so as to tighten the leader strip 7. This possibility of tightening is essential in order that a slack "strip bag" is not formed between the last drying cylinder 2*a* in the forward dryer section 11 and the film size press 10. Owing to the separate journalling, the ropes $K_1$,$K_2$ can be set at a crawling speed when they are not needed for tail threading (while the drying cylinder 2*a* is often at full web running speed). Similar separately journalled rope-groove rings may also be arranged in connection with the rolls $\mathbf{10}_1$,$\mathbf{10}_2$ of the film size press 10 in order to produce a crawling speed. However, fitting of separately journalled rope-groove rings 9 in connection with the paper guide rolls $P_j$ is even more important than fitting of these rings in connection with the rolls $\mathbf{10}_1$,$\mathbf{10}_2$ of the film size press.

FIG. 2D shows schematically an alternative to the separately journalled rope-groove ring 9 shown in FIG. 2C which is a separate rope pulley 19. Such a separate rope pulley 19 is preferable, because it can be journalled by means of a separate bearing means 19*a* directly on a shaft 2*a*' of the cylinder 2*a*, or on the shaft of a roll, respectively. In such a case, the size of the bearing 19*a* is also substantially smaller and, therefore, the bearing is also substantially less expensive.

As a summary of the above, it can be considered an important feature of the invention that the transfer of the leader strip to the ropes is already carried out before the last drying cylinder 2*a*. In this manner, a significant advantage is obtained that, at the point of transfer to the ropes, the leader strip is supported by the drying wire, for which reason it can be shifted sideways into the rope gap easily and in a controlled manner.

Above, the invention has been described by way of example with reference to the figures in the accompanying drawing. The invention is however, not confined to the exemplifying embodiments illustrated in the figures in the drawing alone, which embodiments concern threading through a size press, but different embodiments of the invention may show variation within the scope of the inventive idea defined in the accompanying patent claims. It can be considered to be an advantageous embodiment of the invention that the threading in accordance with the invention by means of ropes is highly usable also when a leader strip is threaded through a soft calender or through an equivalent device which is not followed by an after-dryer section.

We claim:

1. A device for threading a paper web from a dryer section to a finishing device situated after the dryer section in a running direction of the web, the dryer section including a last drying cylinder arranged in the running direction of the web and the web being supported on a drying wire in the dryer section and carried by the drying wire over the last drying cylinder, comprising a pair of ropes, guide means for guiding said ropes in a substantially common loop at least over the last drying cylinder and into the finishing device at a side of the web, forming means for forming a rope gap between said ropes at a location before the last drying cylinder, and transfer means for transferring a portion of the web while the portion of the web is support the drying wire at a location before the last drying cylinder into said rope gap between said ropes such that the portion of the web is carried between said ropes over the last drying cylinder and into the finishing device.

2. The device of claim 1, wherein said rope gap forming means are arranged to form said rope gap at an inlet side of the last drying cylinder in the dryer section.

3. The device of claim 1, wherein said transfer means comprise a blow nozzle for directing an air blowing at the portion of the web from a location in opposed relationship to an interior region of the drying wire in a direction toward said rope gap and at an angle in relation to a direction transverse to the running direction of the web such that the air blowing moves the portion of the web in the direction transverse to the running direction of the web into said rope gap.

4. The device of claim 1, further comprising tightening means arranged in connection to the last drying cylinder for tightening the portion of the web and providing a speed differential for the portion of the web between the last drying cylinder over which it is carried on the drying wire and the finishing device into which it is carried between said ropes, said tightening means comprising a rope-groove ring having a recess for receiving said ropes, and bearing means for mounting said rope-groove ring on the last drying cylinder such that said rope-groove ring is rotatable at a different speed than the last drying cylinder.

5. The device of claim 1, further comprising tightening means arranged in connection to the last drying cylinder for tightening the portion of the web and providing a speed differential for the portion of the web between the last drying cylinder over which it is carried on the drying wire and the finishing device into which it is carried between said ropes, the last drying cylinder having a shaft, said tightening means comprising a rope pulley having a recess for receiving said ropes, and bearing means for mounting said rope pulley on the shaft of the last drying cylinder such that said rope pulley is rotatable at a different speed than the last drying cylinder, said rope pulley extending from a mounting location proximate the shaft to a location adjacent an outer surface of the last drying cylinder.

6. The device of claim 1, wherein after threading of the portion of the web into the finishing device, the speed of said ropes is set to a crawling speed.

7. The device of claim 1, wherein the finishing device is a film size press and an after-dryer section is situated after the film size press, said guide means being arranged to guide said ropes from the dryer section into and through the film size press and into the after-dryer section.

8. The device of claim 1, wherein the finishing device is a calender, said guide means being arranged to guide said ropes from the dryer section into and through the calender.

9. The device of claim 1, wherein said rope gap forming means comprise a rope pulley over which only one of said ropes runs.

10. An arrangement for threading a paper web from a dryer section to a finishing device situated after the dryer section in a running direction of the web, comprising a drying cylinder arranged in the dryer section, a drying wire for supporting the web in the dryer section and carrying the web over said last drying cylinder, a pair of ropes, guide means for guiding said ropes in a substantially common loop at least over said drying cylinder and into the finishing device at a side of the web, forming means for forming a rope gap between said ropes at a location before said drying cylinder, and transfer means for transferring a portion of the web while the portion of the web is supported on said drying wire at a location before said drying cylinder into said rope gap between said ropes such that the portion of the web is carried between said ropes over said drying cylinder and into the finishing device.

11. The arrangement of claim 10, wherein said rope gap forming means are arranged to form said rope gap at an inlet side of said drying cylinder.

12. The arrangement of claim 10, wherein said transfer means comprise a blow nozzle for directing an air blowing at the portion of the web from a location in opposed relationship to an interior region of said drying wire in a direction toward said rope gap and at an angle in relation to a direction transverse to the running direction of the web such that the air blowing moves the portion of the web in the direction transverse to the running direction of the web into said rope gap.

13. The arrangement of claim 10, further comprising tightening means for tightening the portion of the web and providing a speed differential for the portion of the web between said drying cylinder over which it is carried on said drying wire and the finishing device into which it is carried between said ropes, said tightening means comprising a rope-groove having a recess for receiving said ropes, and bearing means for mounting said rope-groove on said drying cylinder such that said rope-groove ring is rotatable at a different speed than said drying cylinder.

14. The arrangement of claim 10, further comprising tightening means for tightening the portion of the web and providing a speed differential for the portion of the web between said drying cylinder over which it is carried on said drying wire and the finishing device into which it is carried between said ropes, said drying cylinder having a shaft, said tightening means comprising a rope pulley having a recess for receiving said ropes, and bearing means for mounting said rope pulley on the shaft of said drying cylinder such that said rope pulley ring is rotatable at a different speed than said drying cylinder, said rope pulley extending from a mounting location proximate the shaft to a location adjacent an outer surface of said drying cylinder.

15. The arrangement of claim 10, wherein after threading of the portion of the web into the finishing device, the speed of said ropes is set to a crawling speed.

16. The arrangement of claim 10, wherein the finishing device is a film size press and an after-dryer section is situated after the film size press, said guide means being arranged to guide said ropes from the dryer section into and through the film size press and into the after-dryer section.

17. The arrangement of claim 10, wherein the finishing device is a calender, said guide means being arranged to guide said ropes from the dryer section into and through the calender.

18. The arrangement of claim 10, wherein said rope gap forming means comprise a rope pulley over which only one of said ropes runs.

* * * * *